United States Patent [19]

Bruce, Jr.

[11] Patent Number: 4,803,517

[45] Date of Patent: Feb. 7, 1989

[54] MULTI-MODE ELECTROPHOTOGRAPHIC REPRODUCTION APPARATUS

[75] Inventor: William H. Bruce, Jr., Walworth, N.Y.

[73] Assignee: Eastman Kodak Company, Rochester, N.Y.

[21] Appl. No.: 81,765

[22] Filed: Aug. 5, 1987

[51] Int. Cl.[4] ..... G03G 15/00

[52] U.S. Cl. ..... 355/3 CH; 355/3 BE; 355/3 R; 355/14 CH; 355/16

[58] Field of Search ..... 355/3 R, 3 CH, 3 BE, 355/8, 14 CH, 16, 7, 67; 358/385; 356/446

[56] References Cited

U.S. PATENT DOCUMENTS

| | | | |
|---|---|---|---|
| 3,597,071 | 7/1971 | Jones | 355/11 X |
| 4,134,668 | 1/1979 | Coburn | 355/3 R |
| 4,239,383 | 12/1980 | Peterson | 355/67 |
| 4,330,195 | 5/1982 | Lavallee | 355/3 R |
| 4,345,835 | 8/1982 | Kramer | 355/14 R X |
| 4,365,888 | 12/1982 | Hosaka et al. | 355/14 R |
| 4,379,631 | 4/1983 | Kitamura | 355/14 R |
| 4,477,175 | 10/1984 | Snelling | 355/3 R |
| 4,527,885 | 7/1985 | Ayata et al. | 355/3 R |
| 4,527,886 | 7/1985 | Inamori et al. | 355/3 R |
| 4,580,172 | 4/1986 | Rajogopal | 355/8 |
| 4,589,759 | 5/1986 | Fantuzzo et al. | 355/3 SH X |
| 4,640,601 | 2/1987 | Deguchi et al. | 355/3 R |
| 4,668,072 | 5/1987 | Yasuda | 355/3 BE X |
| 4,682,040 | 7/1987 | Hohki et al. | 356/446 |

*Primary Examiner*—A. C. Prescott
*Assistant Examiner*—Jane Lau
*Attorney, Agent, or Firm*—Lawrence P. Kessler

[57] ABSTRACT

A multi-mode apparatus for electrophotographically reproducing electronically generated information or information obtained optically from a document. This apparatus comprises a photoconductive belt mounted for movement about a closed loop path through electrophotographic process stations. A light emitting component, associated with the photoconductive belt, produces light images from electronically generated signals. Further, a mechanism, associated with the photoconductive belt, supports a lamp and a lens assembly for movement relative to a transparent document-supporting platen of the apparatus. Movement of the photoconductive belt and the supporting mechanism are controlled whereby during optical reproduction, the belt is held stationary while the supporting mechanism is moved to expose the belt to a light image of a document on such platen, and on reproduction of electronically generated information, the belt is moved past the light emitting component.

11 Claims, 10 Drawing Sheets

MULTI-MODE ELECTROPHOTOGRAPHIC REPRODUCTION APPARATUS

RELATED APPLICATIONS

This application is related to U.S. patent application Ser. No. 81,764, entitled PHOTOCONDUCTIVE MEMBER MOUNTING MECHANISM FOR AN ELECTROPHOTOGRAPHIC REPRODUCTION APPARATUS, filed on even date in the name of Kenin et al.

BACKGROUND OF THE INVENTION

This invention is directed in general to electrophotographic reproduction apparatus, and more particularly to a multi-mode electrophotographic apparatus capable of reproducing electronically generated information or information obtained optically from a document.

Electrophotographic reproduction apparatus typically reproduce information by exposing a uniformly charged photoconductive surface to a light image of information. The light image modifies the uniform charge on the photoconductive surface so as to form a charge pattern, or latent image, on the surface corresponding in an image-wise configuration to the information to be reproduced. Pigmented marking particles, exhibiting a charge of opposite polarity to that of the latent image charge pattern, are brought into contact with the photoconductive surface and adhere to the areas of the surface where the charge pattern exists to develop the latent image and form a transferable image. Thereafter, the transferable image is transferred to a receiver member and permanently fixed to such member by heat and/or pressure to form the desired reproduction.

Exposing of the photoconductive surface has primarily been accomplished by one of two methods. One method of photoconductive surface exposure involves forming a light image of a document (generally referred to as optical copying). In this method, light is directed from a lamp assembly at a document with the light reflected from (or transmitted through) the document being directed through a lens unit into focus on the photoconductive surface. The light from the lamp may illuminate the entire document at one time (referred to as flash exposure), or may be passed through a slit and moved relative to the document to illuminate successive line segments of the document (referred to as scan exposure).

The second method of photoconductive surface exposure involves the use of an electronically controlled light emitting component (generally referred to as nonimpact printing), such as a laser or a plurality of light emitting didoes (LED's). The light emitting component is turned on and off to expose the photoconductive surface in a line-by-line fashion to form a desired charge pattern thereby creating a latent image on the surface corresponding to an image-wise configuration to the information to be reproduced. The information to be reproduced is electronically generated and is used to control the turning on and off of the light emitting component.

While the above described photoconductive surface exposure methods have, in practice, proven to be difficult to incorporate in a single reproduction apparatus, several attempts at their combination have been shown in the literature. Particularly, U.S. Pat. Nos. 4,046,471 (issued Spet. 6, 1977, in the name of Branham et al); 4,355,882 (issued Oct. 26, 1982, in the name of Snelling); and 4,471,175 (issued Oct. 16, 1984, in the name of Snelling) show multi-mode electrophotographic reproduction apparatus which provide for optical copying of documents by reflected light exposure and printing of electronically generated information by light emitting component exposure. The apparatus disclosed in the U.S. Pat. No. 4,046,471 utilizes a complex laser scanner assembly as the light emitting component for electronically generated information printing and margin erase in the optical copying mode. The apparatus disclosed in the U.S. Pat. No. 4,355,882 also utilizes a complex laser scanner assembly. This apparatus also requires an asynchronous photoconductive belt drive to accommodate for differences in speeds necessary to accomplish laser scanning and electrophotographic processing. The apparatus disclosed in the U.S. Pat. No. 4,471,175 utilizes a simplified LED assembly as the light emitting component. However, it requires a complex prism/lens mechanism for focusing both the LED produced image and the optically produced image at the photoconductive member surface.

SUMMARY OF THE INVENTION

This invention is directed to a multi-mode apparatus for electrophotographically reproducing electronically generated information or information obtained optically from a document. This apparatus comprises a photoconductive belt mounted for movement about a closed loop path through electrophotographic process stations. A light emitting component, associated with the photoconductive belt, produces light images from electronically generated signals. Further, a mechanism, associated with the photoconductive belt, supports a lamp and a lens assembly for movement relative to a transparent document-supporting platen of the apparatus. Movement of the photoconductive belt and the supporting mechanism are controlled whereby during optical reproduction, the belt is held stationary while the supporting mechanism is moved to expose the belt to a light image of a document on such platen, and on reproduction of electronically generated information, the belt is moved past the light emitting component.

According to one preferred embodiment of this invention, the supporting mechanism may include a charger which moves with the supporting mechanism in one mode and is stationary while the photoconductive belt moves past the charger during the other mode. In another preferred embodiment of this invention, the supporting mechanism may also include apparatus for converting a document into electrical signals as the support mechanism is moved relative to the platen.

With the multi-mode electrophotographic reproduction apparatus according to this invention, by employing a moving photoconductive belt and stationary exposure mechanism, a high quality, low cost apparatus is provided for reproducing electronically generated information (i.e., a nonimpact printer). At the same time, by employing a stationary photoconductive belt and moving exposure optics for reproducing documents (i.e., a copier),. reduction in the size, number of parts, and cost for the apparatus is achieved.

The invention, and its objects and advantages, will become more apparent in the detailed description of the preferred embodiments presented below.

BRIEF DESCRITPION OF THE DRAWINGS

In the detailed description of the preferred embodiments of the invention presented below, reference is made to the accompanying drawings, in which.

DESCRIPTION OF THE PREFERRED EMBODIMENTS

Figure 1:
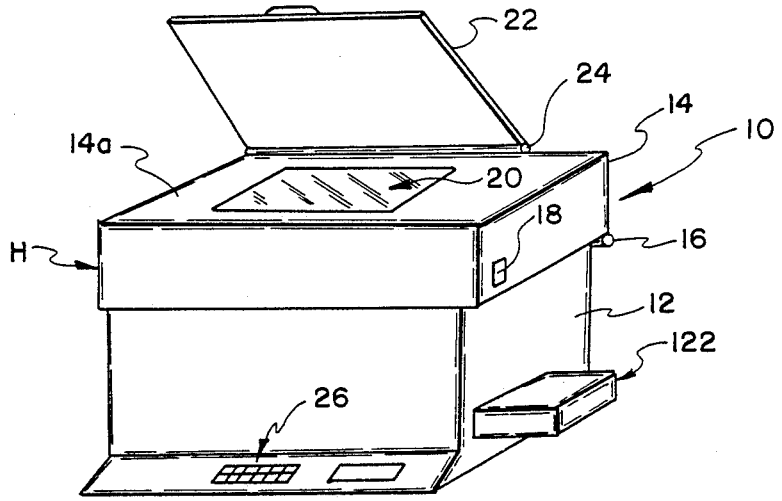
FIG. 1 is a view, in perspective, of the multi-mode electrophotographic reproduction apparatus according to this invention.
Figure 2:
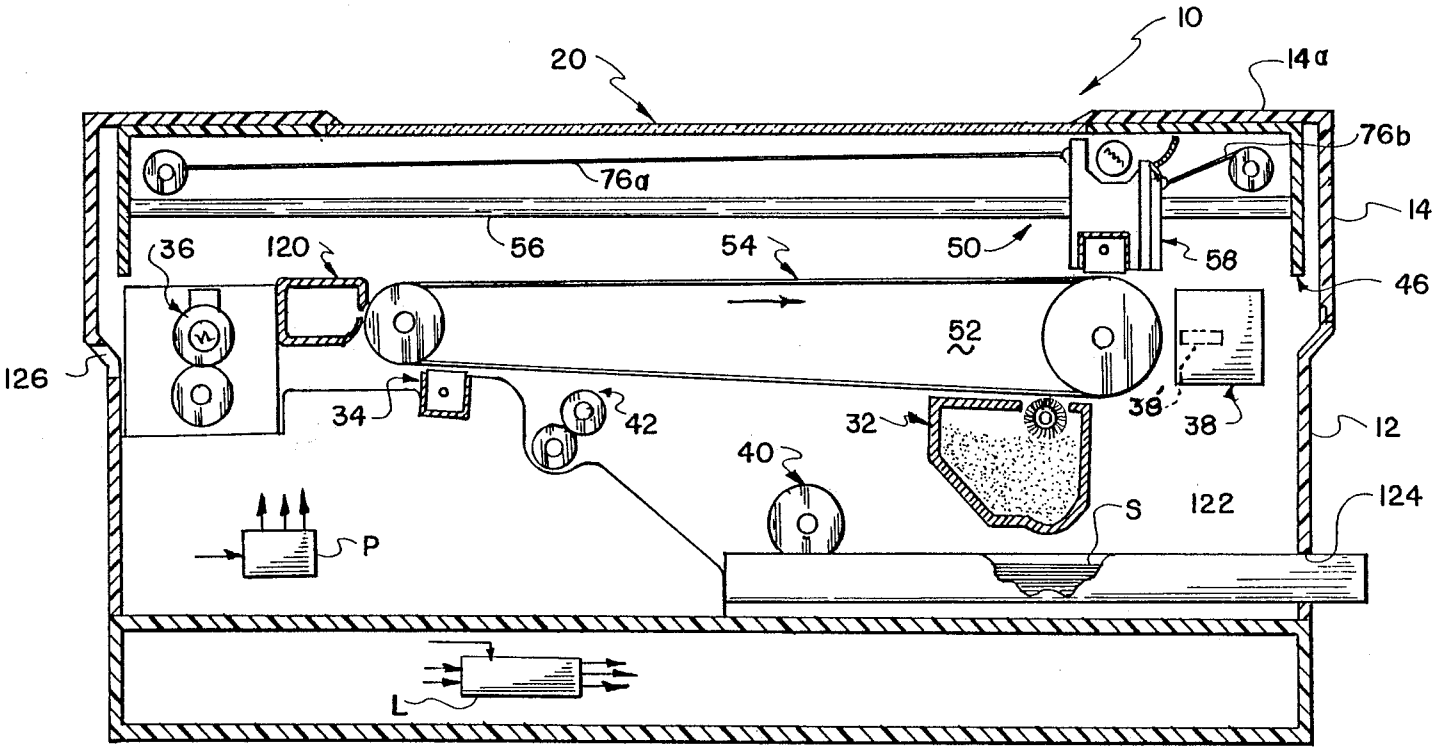
FIG. 2 is a front elevational view of the multi-mode electrophotographic reproduction apparatus of FIG. 1 on an enlarged scale, in cross-section, and with portions broken away or removed to facilitate viewing.
Figure 3:
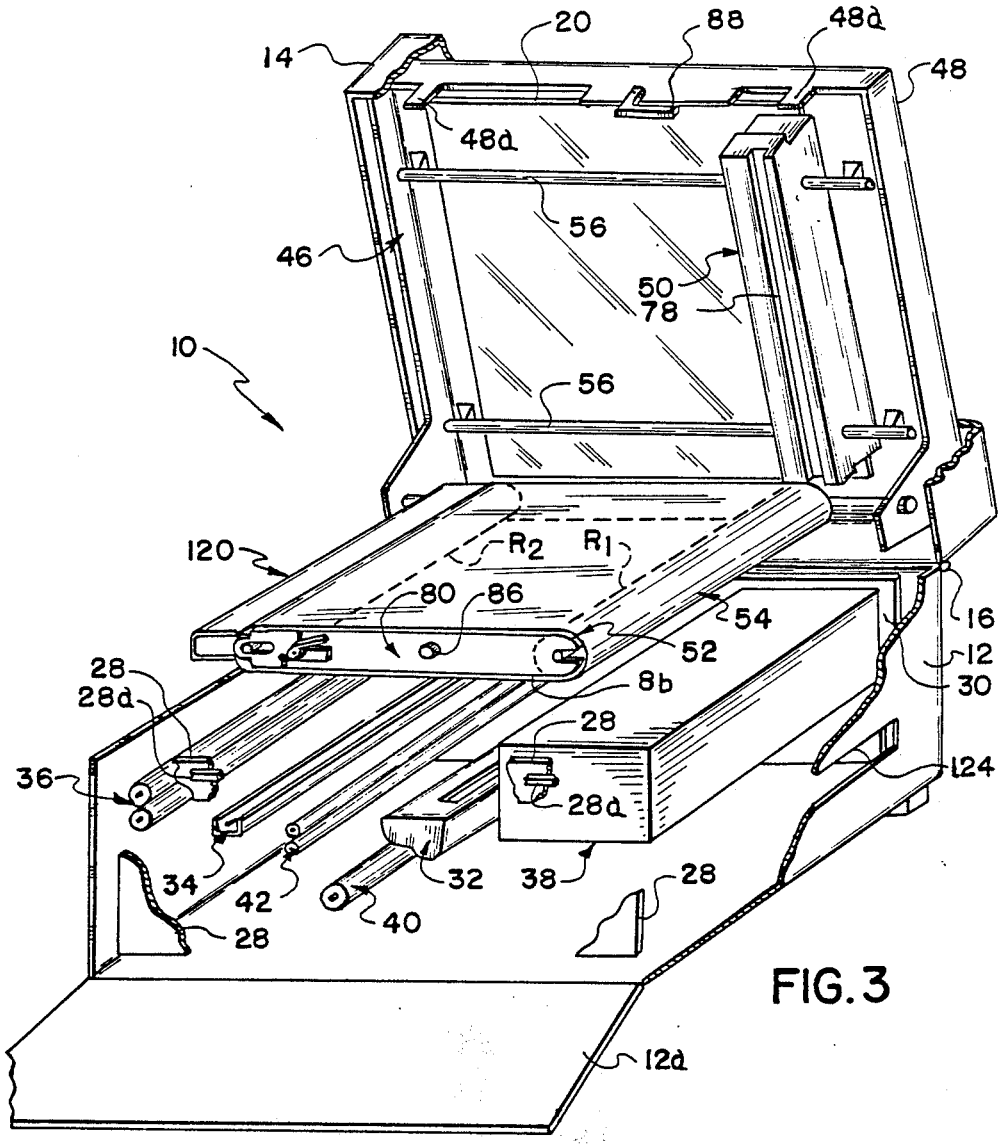
FIG. 3 is a view, in perspective, of the multi-mode electrophotographic reproduction apparatus with portions in a position to enable ready access to the apparatus interior.

Referring now to the accompanying drawings, FIGS. 1–3 show a multi-mode electrophotographic reproduction apparatus, designated generally by the numeral 10, according to this invention. The apparatus 10 includes a housing H having a lower portion 12 and an upper portion 14 interconnected by a hinge mechanism 16. The upper and low housing portions 12, 14 are retained in a closed relation by a latch 18, with release of the latch enabling the portions to be opened (see FIG. 3) to permit access to the interior of the apparatus 10. The upper portion 14 has a stationary transparent platen 20, formed in the top surface 14a thereof, for supporting a document to be optically reproduced. An opaque cover member 22 is connected to the upper portion 14 by an articulating hinge mechanism 24. The member 22 is thus capable of covering a document placed on the platen 20 for optical reproduction, or articulated to hold a book (or other three dimensional object to be optically reproduced) on the platen. A front panel 12*a* of the lower portion 12 of the housing H is opened to provide access to the interior of the apparatus 10.

The lower portion 12 of the housing H has a control panel 26, located at the bottom front thereof beneath the panel 12*a*. The control panel 26 is operatively coupled to a logic and control unit L for the apparatus 10 and enables an operator to select operating parameters for the apparatus and monitor its functions. The logic and control unit L includes, for example, a microprocessor receiving operator input signals and timing signals. Based on such signals and a program from the microprocessor, the unit L produces signals to control the operation of the apparatus 10 for carrying out the reproduction process. The production of the pgoram for a number of commercially available microprocessors such as an INTEL Model 8080 or Model 8085 microprocessor (which along with others are suitable for use with this invention) is a conventional skill well understood in the art. The particular details of any such program would, of course, depend on the architecture of the designated microprocessor.

Figure 12:
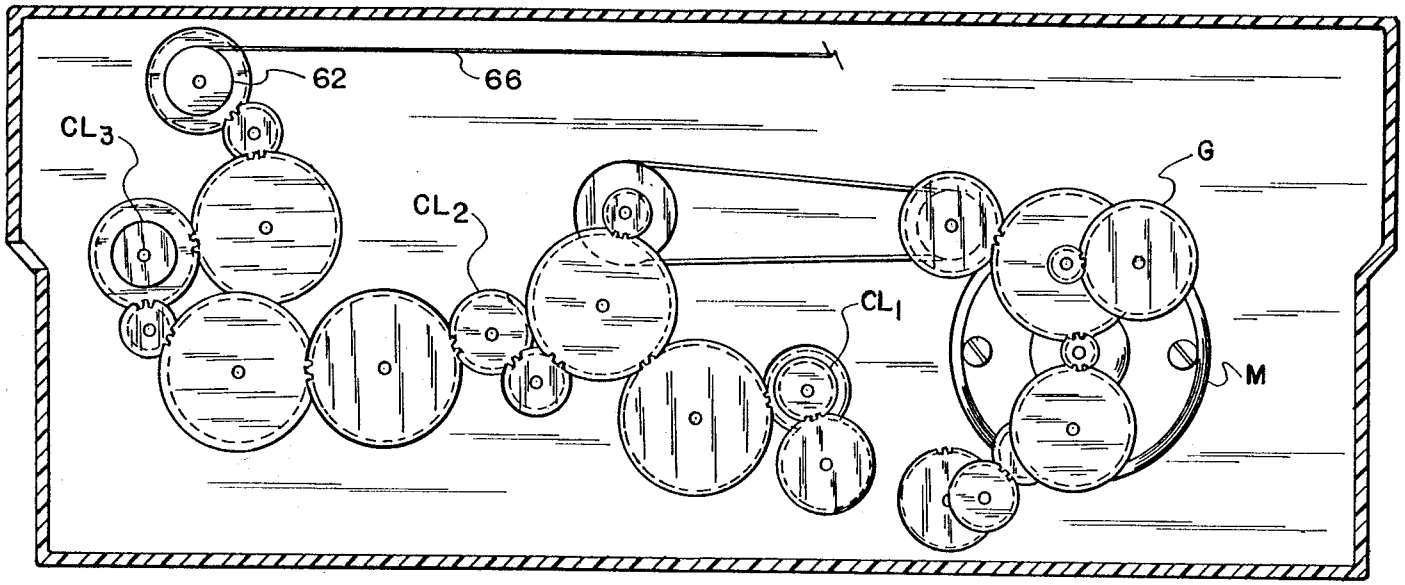
FIG. 12 is a front elevational view, partly in cross-section, of the drive mechanism for the multi-mode electrophotographic reproduction apparatus according to this invention with portions broken away or removed to facilitate viewing.

A pair of oppositely disposed machine plates 28, 30, are located within the lower portion 12 of the housing H. The plates serve to locate, and relatively position, various elements utilized in the electrostatogrphic process for image reproduction as will be discussed in detail hereinbelow. Such elements include, for example, a magnetic brush developer station 32, a transfer charger 34, and a heat/pressure fuser assembly 36. Additionally, the plates support a mechanism 38 for reproducing electronically generated information, a receiver member feed mechanism 40, and receiver member registration mechanism 42. Further, a drive assembly 44 (See FIG. 12) is supported by the rear plate 30. The drive assembly 44 includes a motor M, gear train G and a plurality of clutches $CL_1$–$CL_3$ interrelated in a well known manner for effecting operation of various components and elements of the apparatus 10. Of course, other drive assemblies, such as belts and pulleys, are suitable for use with this invention.

The upper portion 14 of the housing H contains a supporting member 46 in the form of a rigid frame 48. The frame serves to locate and relatively position an optical exposure assembly 50 and an assembly 52 for supporting a photoconductive belt 54. The photoconduc5tive belt 54 is a composite structure containing a dielectric support covered with a typical photoconductive material such as shown, for example, in U.S. Pat. No. 3,615,414, issued Oct. 26, 1971 in the name of Light. Of course, other organic or inorganic photoconductive materials are suitable for use with this invention. Moreover, the photoconductive belt may be bi-polar; that is it may accept a positive or negative charge. Exposure will therefore alternatively generate a charge pattern for development with pigmented marking particle of the same charge characteristics by discharging either that portion of the image corresponding to the information content to be reproduced or the background. This enables optical exposure to erase the background of a document to be reproduced with subsequent development of the information content of such document. On the other hand, the mechanism for reproducing electronically generated information erases, and subsequently developes, the information content for a reduced duty cycle of such mechanism.

The optical exposure assembly 50 comprises a pair of rails 56 fixed to the frame 48 beneath, and outboard of, the platen 20. A carriage 58 is slidably mounted on the rails 56. The carriage 58 comprises a housing 60 extending, in the direction from front to back of the apparatus 10, substantially the full length of the platen 20. Movement of the carriage 58 along the rails 56 is accomplished by the drive assembly 44 which is coupled to a spool 62 through a clutch $CL_3$. The spool 62 is, in turn, connected to one side of the carriage housing 60 through a wire 66 (see FIG. 4), wound up on the spool on actuation of the clutch to move the housing along the rails from a parked position (shown in FIG. 2) for a distance substantially equal to the width of the platen 20. A spring 68 connected to the oppsoite side of the carriage housing 60 urges the housing in a direction whereby the housing is returned to its parked position on deactuation of the clutch $CL_3$.

Figure 4:
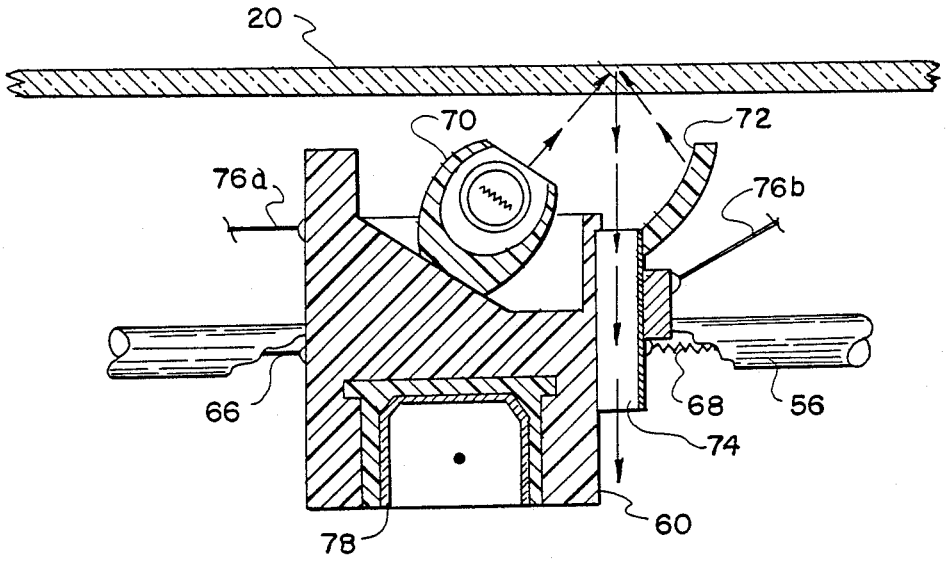
FIG. 4 is a front elevational view of the optical exposure assembly on an enlarged scale, in cross-section and with portions broken away or removed to facilitate viewing.

As best shown in FIG. 4, the carriage housing 60 of the optical exposure assembly supports an exposure lamp 70. An integral reflector 72 extends from the housing 60 and directs light from the lamp 70, when energized, in a line segment toward the platen 20. Such light reflects off of a document on the platen as the carriage 58 is moved by the drive assembly 44 from its parked position along the rails 56. A lens assembly 74 is supported by the carriage housing 60 at a location which enables the reflected light image to be focused on the photoconductive belt 54. The lens assembly 74 may be, for example, a linear lens arrays which extends for the full dimensions of the platen 20 in the direction transverse to the direction of movement of the carriage 58 along the rails 56. A pair of opaque, spool-wound, shades **76*a*, 76*b* are respectively coupled to opposite sides of the housing 60 and wind/unwind therewith so that only light passing through the lens assembly 74 exposes the photoconductive belt 54. The housing 60 also supports a primary corona charger 78, which is located immediately upstream of the lens assembly 74 and similarly extends for the full dimension of the platen 20 in the direction transverse to the direction of movement of the carriage 58 along the rails 56. The charger 78 is energized by a power supply source P to provide for placement of a uniform electrostatic charge on the photoconductive belt 54** in the manner to be described hereinbelow.

The assembly 52 for supporting the photoconductive belt 54 is best shown in FIGS. 6–11. Such assembly comprises a pair of rollers $R_1$, $R_2$ supported by a torque (see FIG. 3). The torque frame, which maintains the rollers $R_1$, $R_2$ in substantial relative alignment, is in turn supported at its rearwardly facing end **80*a* on a pivot shaft 82 carried by a portion 84 of the rigid frame 48 of the supporting member 46. The forwardly facing end 80*b* of the torque frame has a pin 86 extending outwardly therefrom. The pin 86 is adapted to be engaged by a latching mechanism 88 carried by the rigid frame 48. Such engagement retains the assembly 52 in the supporting member 46 in accurate positional relation to the platen 20 (see FIG. 6), and thus relative to the optical exposure assembly 50. The rigid frame 48 has a pair of datums 48*a* which respectively engage a pair of datums 28*a* extending from the machine plate 28 when the upper portion 14 is in its closed position. The cooperative engagement of the datums assures accurate location of the upper portion with the electrostatographic process stations in the lower portion 12. A rod 89 is connected to the portion 84 of the rigid frame 48 and is engaged by a torsion bar 90 coupled to the machine plate 30. The torsion bar 90 applies a force to the rod 89 which acts to counter balance the weight of the upper portion 14 of the housing H when such upper portion is pivoted about the hinge 16 (see FIG. 7) to an open position to provide access to the interior of the apparatus 10. When the portion 14 is in its open position, the latching mechanism 88 may be released to enable the torque frame 80 to pivot about the shaft 82 to a position (see FIG. 8) where removal and replacement of the photoconductive belt 54** is facilitated.

Figure 9:
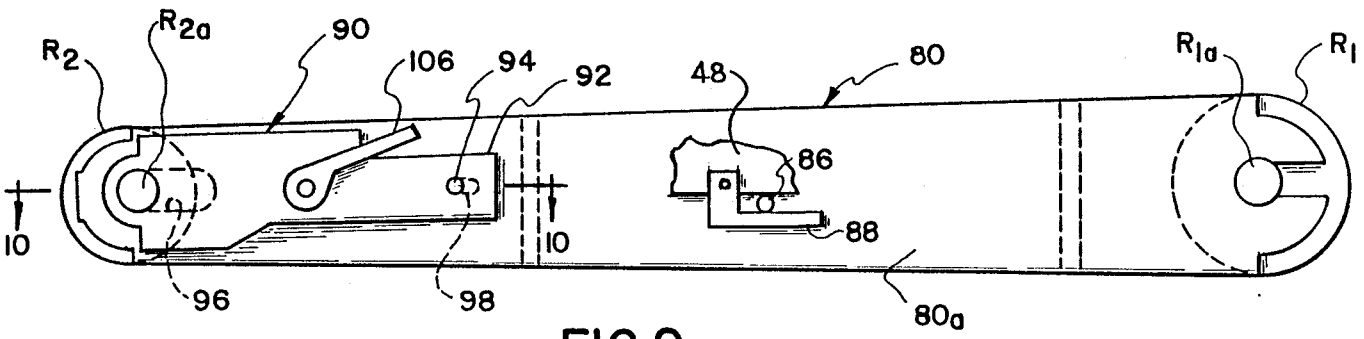
FIG. 9 is a front elevational view of the photoconductive belt support including a tensioning mechanism, partly in cross-section and with portions broken away or removed to facilitate viewing.
Figure 11:
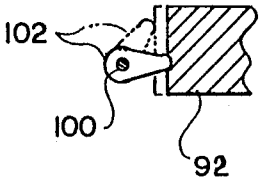
FIG. 11 is a front elevational view of the cam assembly for the photoconductive belt support tensioning mechanism.
Figure 10:
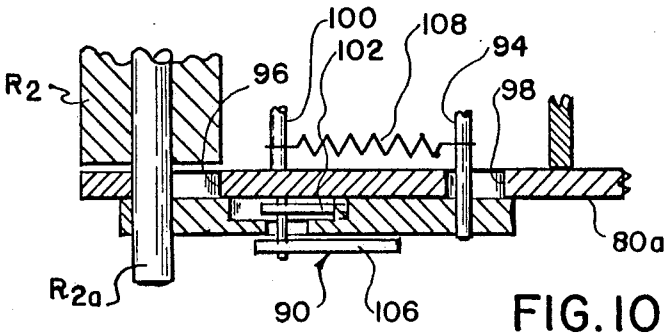
FIG. 10 is a top plan view of the photoconductive belt support tensioning mechanism, partly in cross-section and with portions broken away or removed to facilitate viewing.

The run of the photoconductive belt 54 facing the platen 20 must be held in a substantially planer configuration for focused exposure of a reflected light image of a document to be reproduced. At the same time, the photoconductive belt 54 must be capable of being readily removable for replacement. To accomplish these ends, the torque frame 80 includes a mechanism T for inducing tension in the belt 54 entrained about the rollers $R_1$, $R_2$. The tensioning mechanism T includes a pair of plates 92 (only one side of the tensioning mechanism is shown in FIGS. 9, 10, with the opposite side being of mirrored construction). The plates 92, at one end, capture the shaft $R_{2a}$ of the roller $R_2$. The captured shaft $R_{2a}$ passes through slots 96 formed in the ends 801, **80*b* of the torque frame 80. A rod 94, connected between the plates 92 adjacent to their ends opposite the shaft capturing ends, passes through slots 98 formed in the torque frame ends 80*a*, 80*b*. A shaft 100 is captured by, and extends between, the ends 80*a*, 80*b* intermediate of the roller $R_2$ and the rod 94. The shaft 100 carries cam members 102 immediately outboard of the ends 80*a*, 80*b*. The cam members 102 respectively engage a cam surface 104 formed in the plates 92 (see FIG. 11). Rotation of the shaft 100 to control the relative engagement of the cam members and surfaces is controlled by a lever 106 mounted on the shaft outboard of the plate 92 adjacent to the end 80*a* of the torque frame. As such, the lever 106 is readily accessible to an operator when the portion 14 of the apparatus 10 is in its open position and the torque frame 80 is in its position of FIG. 8. A tension mechanism 108, such as a coiled tension spring, is connected between the shaft 100 and rod 94 to urge the plates 92, and thus the roller $R_2$ toward the left in FIGS. 9 and 10. Accordingly, when the lever 106 is in a position to set the relationship between cam members 102 and respective cam surfaces 104 as shown in phantom lines in FIG. 11, a force is supplied to the roller $R_2$ so that tension is applied to the belt 54 to maintain a planer configuration for its upper run between the rollers $R_1$ and $R_2$. Alternatively, when the lever 106 is in a position to set the relationship between cam members 102 and respective cam surfaces 104 as shown in solid lines in FIG. 11, the roller $R_2$ is moved to the right to relieve the tension in the belt 54**. The belt is thus readily removable from the rollers so as to be easily replaced with a new belt.

Figure 13:
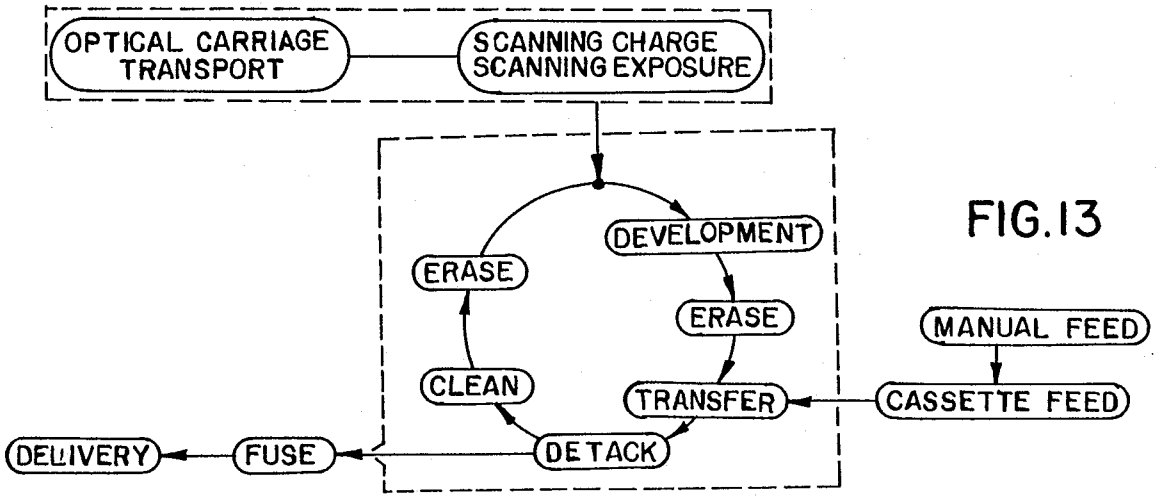
FIG. 13 is a schematic illustration of the optical reproduction mode of operation for the multi-mode electrophotographic reproduction apparatus according to this invention.

Turning now to the operation of the above described multi-mode electrophotographic reproduction apparatus according to this invention, such apparatus is capable of making optical reproductions of documents (functions as a copier) or reproductions of electronically generated information (function as a nonimpact printer). The operative cycle for optical reproduction is schematically illustrated in FIG. 13. A document to be reproduced is placed on the platen 20 under the member 22, and the operator programs the apparatus 10 for a desired number of reproductions, for example, by inputting such information to the logic and control unit L through the operator control panel 26. When the operator depresses a start button on the panel 26, the logic and control unit L actuates the drive assembly 44 to move the carriage 58 from its parked position along the rails 56 under the platen 20 to a position at the far left of the rails (when viewing FIG. 2 for example). As this right-to-left carriage movement is begun, the primary charger 78 is activated and the lamp 70 is turned on. The primary charger 78 deposits a uniform electrostatic charge on the photoconductive belt which is subsequently modified, in a line-by-line fashion, to form the latent image charge pattern by scan projection of the focused light reflected image of the document provided through the lens assembly 74 oriented in the carriage 58 immediately behind the primary charger.

At the end of travel of the carriage 58, the primary charger 78 and lamp 70 are turned off, and the housing is returned (to the right) to its parked position. Substantially simultaneously, the drive assembly 44 initiates drive of the photoconductive belt supporting rollers $R_1$, $R_2$ to transport the belt 54 clockwise (when viewing FIG. 2) in a closed loop path about the rollers. The area of the belt containing the latent image charge pattern is thus successively transported through the electrostatographic process stations. That is, such area is brought into operative association with the developer station 32 where pigmented marking particles are adhered to the charge pattern to develop a transferrable image, to the area beneath the transfer charger 34 where such image is transferred to a receiver member, and then through a cleaning station 120 where any residual marking particles are removed prior to reuse of that area of the belt.

The receiver member to which the marking particle iamge is transferred is typically a cut sheet of plain bond paper. The sheet is, for example, stored within a stack of sheets S held in a cassette 122 which is insertable through an opening 124 in the lower portion 12 of the housing H. The cassette 122, when inserted into the lower portion 12, is held therein in a fixed position in relation to the receiver member feed mechanism 40, such as a friction roller for example. At a proper time determined by the logic and control unit L, the feed roller is actuated by the drive assembly 44 and picks the top most sheet from the cassette 122 and transports such sheet to the receiver member registration mechanism 42, such as a pair of registration rollers for example. The registration rollers, also actuated by the the drive assembly 44, adjust the transport timing of the transport of the receiver sheet so that the sheet is delivered into contact with the photoconductive belt 54 at the vicinity of the transfer charger 34 in register with the transferable image on the belt. As the receiver sheet and the photoconductive belt pass beneath the transfer charger 34, such charger is activated to generate an electrical field which causes the marking particles to migrate from the belt to the receiver sheet. After transfer, the receiver sheet passes from the photoconductive belt 54 to the fuser assembly 36 where the transferred image is fixed to the sheet by heat and/or pressure, and delivered through an exit slot 126 in the lower portion 12 of the housing H for operator retrieval of the finished reproduction. Of course, in accordance with this invention supply of receiver members may be accomplished in other ways such as by being manually fed or fed from a plurality of cassettes stored within the apparatus 10.

Figure 15:
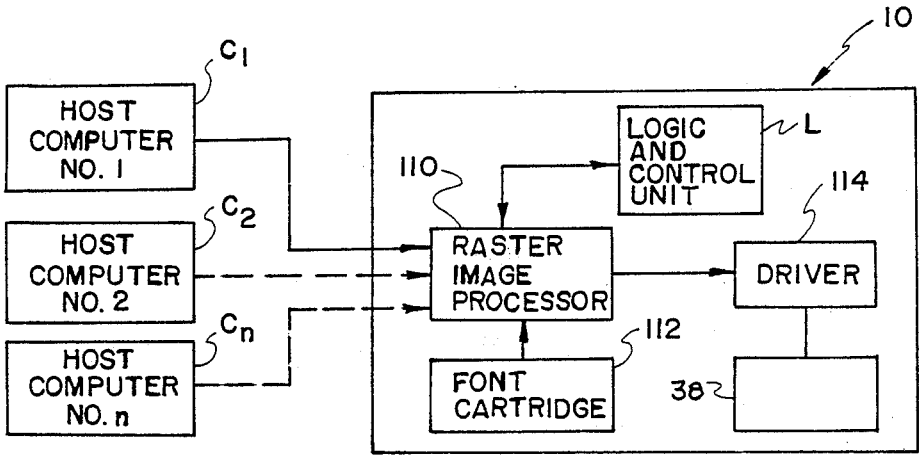
FIG. 15 is a schematic illustration of the electronic input to the multi-mode electrophotographic reproduction apparatus when in its printing mode of operation.
Figure 14:
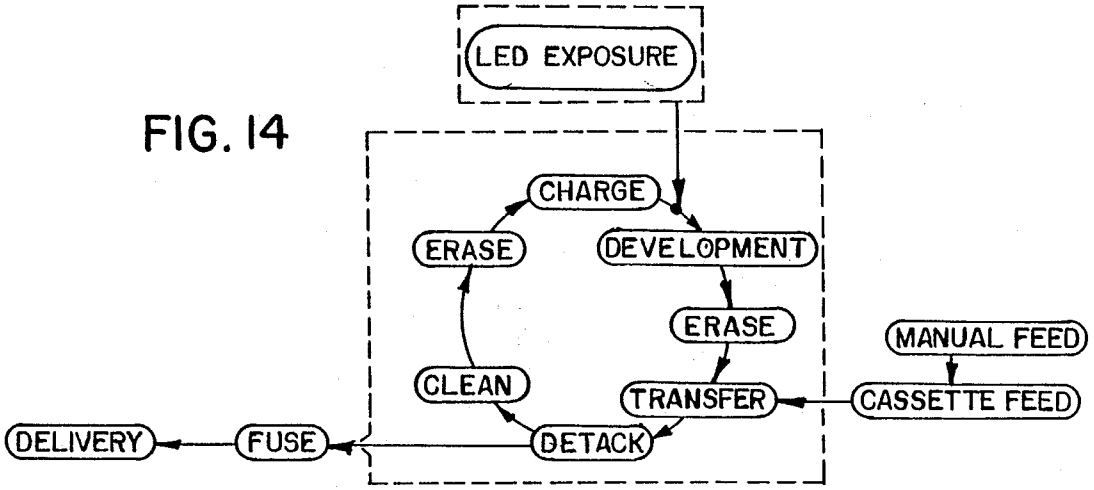
FIG. 14 is a schematic illustration of the printing reproduction mode of operation for the multi-mode electrophotographic reproduction apparatus according to this invention.

The operative cycle for reproduction of electronically generated information is shown schematically in FIG. 14. Prior to describing the operative cycle, a few words are in order regarding the electronic generation of information. Electronically generated information is typically produced by a host computer. The apparatus 10 is capable of interfacing with a plurality of host computers ($C_1$–$C_n$ (see FIG. 15). If more than one computer attempts to send signals to the apparatus 10 at the same time, the logic and control unit L sets priority so that the reproduction of one complete set of information signals from a particular computer are completed before the reproduction of the next set of signals is begun. The information from the computer, in the form of digital electrical signals, is fed to a raster image processor (RIP) 110 under the control of the unit L. The RIP 110 also interfaces with a font cartridge 112 which directs the RIP to form the signals from the computer into a serial train of signals in a particular form corresponding, for example, to a particular style type face for the reproduction. The RIP 110 then feeds the appropriate signal train to a driver 114. The driver 114 is coupled to the mechanism 38 for reproducing electrically generated information so as to activate the mechanism for reproducing the signals in the selected image pattern by appropriate exposure of the photoconductive belt 54. For example, in the illustrated embodiment the mechanism 38 is a series of LED's (extending across the belt in the direction transverse to belt movement) which are turned on for the desired exposure of the belt. Of course, other mechanisms for reproducing electronically generated information, such as an assembly providing for ion deposition for example, are suitable for use with this invention.

When a host computer communicates with the apparatus 10, the logic and control unit L actuates the drive assembly 44 to initiate drive of the photoconductive belt supporting rollers $R_1$, $R_2$ to transport the belt 54 clockwise (when viewing FIG. 2) in a closed loop path about the rollers. Substantially simultaneously the primary charger 78 is activated (with the carriage 58 remaining in its parked position). The primary charger deposits a uniform electrostatic charge on the photoconductive belt which is subsequently modified to form the latent image charge pattern by the activation of the mechanism 38 for scan printing electrically generated information by the driver 114. As with the above described operative cycle for reproducing documents, the area of the belt containing the modified latent image charge pattern is successively transported through the electrostatogrphic process stations in the same manner. That is, image development, receiver member delivery, transfer, fusing, and photoconductive belt cleaning are carried out as described above.

Figure 5:
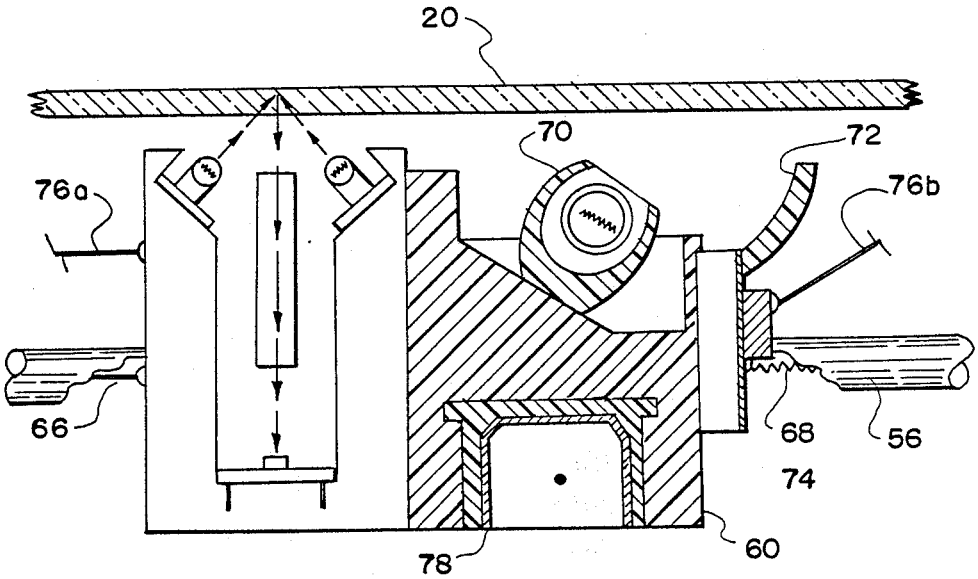
FIG. 5 is a front elevational view, similar to FIG. 4 of an alternate embodiment of the optical exposure assembly including an assembly for converting a document to electrical signals.
Figure 6:
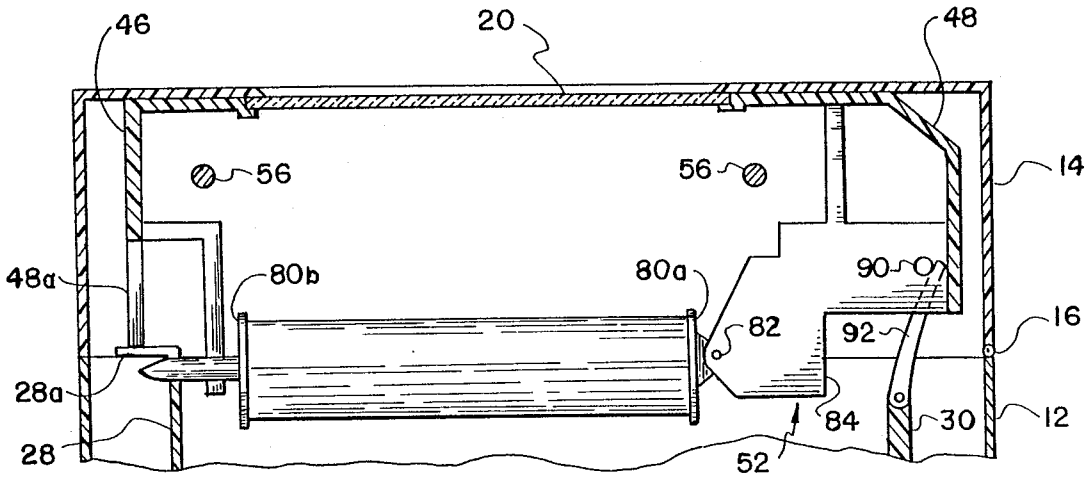
FIG. 6 is an end elevated view of the photoconductive belt support, for the multi-mode electrophotographic reproduction apparatus according to this invention, in its operative position, partly in cross-section and with portions broken away or removed to facilitate viewing.
Figure 7:
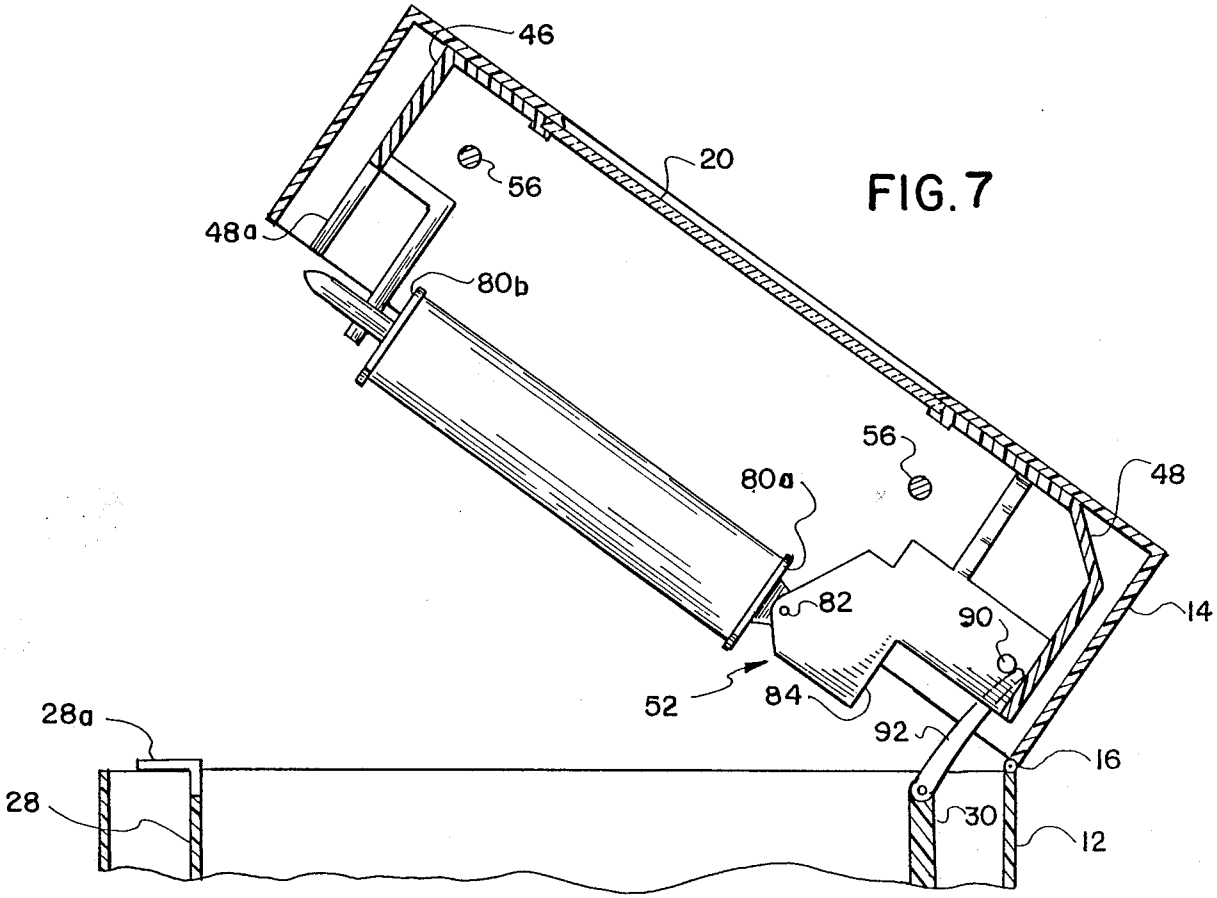
FIG. 7 is an end elevational view of the photoconductive belt support, similar to FIG. 6, in its position to permit access to the interior of the reproduction apparatus.
Figure 8:
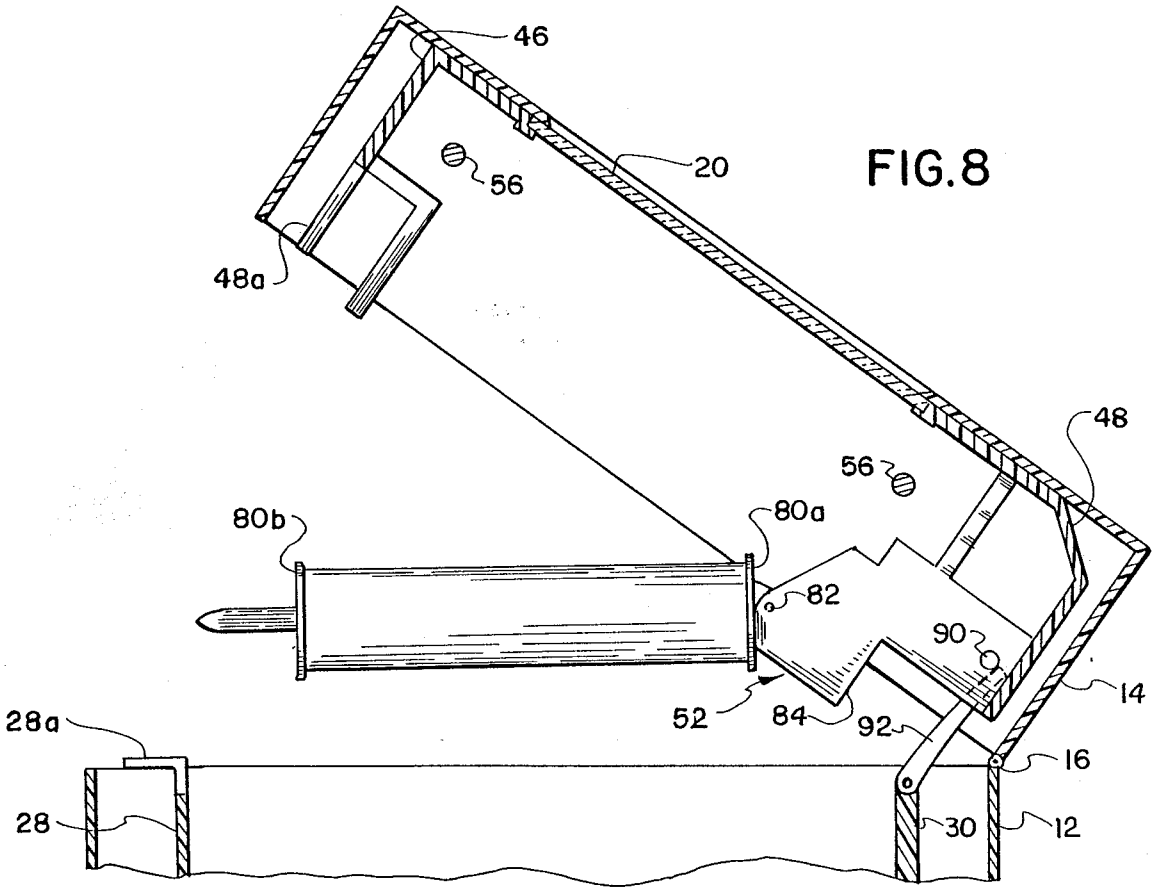
FIG. 8 is an end elevational view of the photoconductive belt support, similar to FIG. 6, in its position to enable the photoconductive belt to be readily removed and replaced.

In an alternative embodiment of the multi-mode electrophotographic reproduction apparatus according to this invention, such apparatus is adapted to perform conversion of documents to electrical signals in addition to its above described modes of operation. In order to accomplish such conversion, the optical exposure assembly 50' takes the form shown in FIG. 5. The carriage 58' of the optical exposure assembly 50' includes a scanning mechanism 130 in addition to a primary charger 78', lamp 70', and lens assembly 74' similar to corresponding elements described above with reference to FIG. 4. The scanning mechanism 130 is capable of converting a light image to corresponding electrical signals. An exemplary scanning mechanism 130 is, for example, a plurality of light emitting elements 132 and a series of light detecting elements 134 such as charge coupled devices (CCD's) arranged in an array extending across the platen 20 in the direction transverse to travel of the photoconductive belt.

To operate the apparatus 10 in the document conversion mode, an operator places a document on the platen 20 under the member 22 and actuates the control panel 26 to indicate to the logic and control unit L that such mode is to be accomplished. The unit L activates the light detecting elements 134 and turns on light emitting elements 132 (the lamp 70' and the primary charger 78' are maintained in their off condition). Substantially simultaneously, the drive assembly 44 is actuated to move the carriage 58' from its parked position along the rails 56' under the platen to a position at the far left of the rails (when viewing FIG. 2 for example). During this right-to-left movement, light from the emitting elements 132 is reflected as a line-by-line light image of the document on the platen and is focused by lens assembly 136 on the detecting elements 134 for sensing annd conversion to corresponding electrical signals. Such signals may be sent to a host computer where they can be displayed, manipulated (for example, to edit the original document), and returned to the apparatus 10 for reproduction according to the above described cycle for reproducing electronically generated information. Of course, the electrical signals from the scanning mechanism 130 may be stored in memory within the apparatus 10 and directly reproduced according to the above described cycle for reproducing electronically generated information.

With the multi-mode electrophotographic reproduction apparatus according to this invention, by employing a moving photoconductive belt and stationary exposure mechanism, a high qulity, low cost apparatus is provided for reproducing electronically generated information (i.e., a nonimpact printer). At the same time, by employing a stationary photoconductive belt and moving exposure optics for reproducing documents (i.e., a copier), reduction in the size, number of parts, and cost for the apparatus is achieved.

The invention has been described in detail with particular reference to preferred embodiments thereof, but it will be understood that variations and modifications can be effected within the spirit and scope of the invention.

I claim:

1. Apparatus utilizing a photoconductive member mounted for movement about a closed loop path through electrophotographic process stations for electrophotographically reproducing electronically generated information or information from a document, said apparatus comprising:

means, located in fixed relation to said photoconductive member closed loop path, for producing images from signals corresponding to electronically generated information;

means, operatively associated with said photoconductive member, for supporting a primary charger, a lamp and a lens assembly for movement relative to a transparent document-supporting platen, said primary charger located relative to said lamp so as to be immediately upstream thereof in the direction of movement of said photoconductive member about it's closed loop path; and means for controlling movement of said photoconductive member and said supporting means whereby during reproduction of a document, said photoconductive member is held stationary while said supporting means is moved to expose said member to a reflected light image of a document on such platen and said primary charger is activated as said supporting means is moved to uniformly charge said photoconductive member prior to exposure, and during reproduction of electronically generated information, said supporting means being held stationary and said photoconductive member is moved past said image producing means, said primary charge being activated to uniformly charge said photoconductive member as said member moves past said supporting means prior to moving past said image producing means.

2. The invention of claim 1 wherein said supporting means further includes means, responsive to a reflected light image of a document on the platen of the reproduction apparatus, for converting such image into electrical signals corresponding image-wise, thereto.

3. The invention of claim 1 wherein said image producing means includes means for receiving electronically generated information and converting such information to appropriate signals and a light emitting component responsive to such signals for exposing said photoconductive member.

4. The invention of claim 3 wherein said light emitting component is a plurality of light emitting diodes.

5. The invention of claim 1 wherein said supporting means includes a pair of rails mounted in fixed relation to the platen, and a carriage slidably engaging said rails, said carriage including a receiver for said lamp, an integral reflector for directing light from said lamp at the platen, a holder for said lens assembly to position said lens assembly for focusing reflected light from a document on the platen onto said belt, and a holder for said primary charger for positioning said charger upstream of said lens assembly.

6. Apparatus utilizing a photoconductive member for electrophotographically reproducing electronically generated information or information from a document, said apparatus comprising:

means for mounting said photoconductive member for movement about a path through electrophotographic process stations;

a light emitting mechanism located at a fixed location relative to said photoconductive member path, said mechanism producing images on said photoconductive member from signals corresponding to electronically generated information;

means, operatively associated with said photoconductive member, for supporting a primary charger, a lamp, and a lens assembly for movement relative to a transparent document-supporting platen; and means for controlling movement of said photoconductive member and said supporting means whereby during optical reproduction of a document, said photoconductive member is held stationary while said supporting means is moved and said primary charger and lamp are activated to uniformly charge said photoconductive member and expose said member to a light image of a document on such platen, and during reproduction of electronically generated information, said supporting means is held stationary, with said primary charger being activated, and said photoconductive member is moved past said supporting means and said light producing means.

7. The invention of claim 6 wherein said supporting means includes a pair of rails mounted in fixed relation to the platne, and a carriage slidably engaging said rails, said carriage including a receiver for said lamp, an integral reflector for directing light from said lamp at the platen, a holder for said lens assembly to position said lens assembly for focusing reflected light from a document on the platen onto said belt, and a holder for said primary charger for positioning said charger upstream of said lens assembly.

8. A multi-mode apparatus utilizing a photoconductive belt for electrophotographically reproducing information, said apparatus comprising:

a housing having a lower portion and an upper portion pivotably connected thereto, said upper portion including a transparent document-supporting platen;

means, located in said upper housing portion, for mounting said photoconductive belt for movement about a closed loop path;

means, located in said upper housing portion between said platen and said photoconductive belt, for supporting a primary charger, a lamp, and a lens assembly for movement relative to said platen and said photoconductive belt;

electrostatographic process means, located in said lower housing portion, for developing a latent image charge pattern on said photoconductive belt with pigmented marking particles, and transferring and fixing the developed image to a receiver member;

means, located in said lower housing portion at a fixed location relative to said photoconductive belt path, for producing light images on said belt from signals corresponding to electronically generated information; and means for controlling movement of said photoconductive belt and said supporting means whereby for optical reproduction of a document, said photoconductive belt is held stationary while said supporting means is moved and said primary charger and lamp are activated to uniformly charge said photoconductive belt and expose said belt to a light image of a document on such platen, and for reproduction is held stationary, with said primary charger being activated, and said photoconductive belt is moved past said supporting means and said light producing means.

9. The invention of claim 8 wherein said supporting means further includes a mechanism for sensing a reflected light image and converting such image to corresponding electrical signals, and wherein said controlling means, for converting a document to electronically generated information, moves said supporting means to provide a reflected light image of a document for application to said sensing and converting means.

10. A combination optical copier and nonimpact printer comprising:

means for supporting a photoconductive belt for movement along an endless path through operative relation with a series of electrophotographic process stations, a portion of such endless path being relatively flat;

a transparent platen adapted to receive a document, said platen being located in substantially spaced parallel relation with said flat portion of such endless path;

movable exposure means mounted between said flat portion and said platen for movement parallel thereto, said movable exposure means including means for scan exposure of a light image of a document received on said platen onto an area of the photoconductive belt located in said flat portion of such endless path while the belt is stationary and said movable exposure means is moved;

stationary exposure means positioned adjacent such endless path for exposure of the photoconductive belt in response to electronic image information while the belt is moved passed said exposure means; and charging means mounted to be movable with said movable exposure means to uniformly charge the photoconductive belt prior to exposure by said movable exposure means as it moves and to be stationary for charging of the moving photoconductive belt prior to exposure by said stationary exposure means.

11. The invention of claim 10 including sensing means for converting an image of a document to an electrical signal corresponding thereto, and electronic scanning means movable with said movable exposure means for scan projecting an image of a document received on said platen onto said sensing means to create such electronic signal.

* * * * *